US008770271B2

(12) United States Patent
Fielder et al.

(10) Patent No.: US 8,770,271 B2
(45) **Date of Patent: *Jul. 8, 2014**

(54) ELECTRIC SUBMERSIBLE PUMPING SYSTEM FOR DEWATERING GAS WELLS

(71) Applicant: Zeitecs B.V., Rijswijk (NL)

(72) Inventors: Lance I. Fielder, Sugar Land, TX (US); Robert Nicholas Worrall, Naples, FL (US)

(73) Assignee: Zeitecs B.V., Rijswijk (NL)

( * ) Notice: Subject to any disclaimer, the term of this patent is extended or adjusted under 35 U.S.C. 154(b) by 0 days.

This patent is subject to a terminal disclaimer.

(21) Appl. No.: 13/850,893

(22) Filed: Mar. 26, 2013

(65) Prior Publication Data

US 2013/0209290 A1 Aug. 15, 2013

Related U.S. Application Data

(63) Continuation of application No. 12/467,560, filed on May 18, 2009, now Pat. No. 8,443,900.

(51) Int. Cl.
*E21B 43/00* (2006.01)

(52) U.S. Cl.
USPC ..... 166/68; 166/66.4

(58) Field of Classification Search
USPC ..... 166/369, 105, 68, 66.4
See application file for complete search history.

(56) References Cited

U.S. PATENT DOCUMENTS 4,352,394 A 10/1982 Zehren
4,583,923 A 4/1986 James
4,928,771 A 5/1990 Vandevier
5,086,196 A 2/1992 Brookbank et al.
5,145,007 A 9/1992 Dinkins
5,191,173 A 3/1993 Sizer et al.
5,207,273 A 5/1993 Cates et al.
5,269,377 A 12/1993 Martin
5,708,337 A 1/1998 Breit et al.
5,769,160 A 6/1998 Owens (Continued)

FOREIGN PATENT DOCUMENTS

GB 2 445 859 A 7/2008
GB 2448928 A 11/2008

(Continued)

OTHER PUBLICATIONS

Baker Hughes—Centrilift Product Report, Alternative Deployed ESP System, Cable/Rod Deployed ESP Systems, Sep. 2008, 6 pages.

(Continued)

*Primary Examiner* — Shane Bomar
*Assistant Examiner* — Robert E Fuller
(74) *Attorney, Agent, or Firm* — Patterson & Sheridan, L.L.P.

(57) ABSTRACT

A pumping system includes a submersible high speed electric motor operable to rotate a drive shaft; a high speed pump rotationally fixed to the drive shaft; an isolation device operable to expand into engagement with a tubular string, thereby fluidly isolating an inlet of the pump from an outlet of the pump and rotationally fixing the motor and the pump to the tubular string; and a cable having two or less conductors, a strength sufficient to support the motor, the pump, and the isolation device, and in electrical communication with the motor. A maximum outer diameter of the motor, pump, isolation device, and cable is less than or equal to two inches.

11 Claims, 4 Drawing Sheets

(56) References Cited

U.S. PATENT DOCUMENTS

| | | | | |
|---|---|---|---|---|
| 5,906,242 | A | 5/1999 | Bruewer et al. | |
| 6,138,765 | A * | 10/2000 | Russell et al. | 166/387 |
| 6,143,988 | A | 11/2000 | Neuroth et al. | |
| 6,168,388 | B1 | 1/2001 | Hughes et al. | |
| 7,396,216 | B2 | 7/2008 | Blauch et al. | |
| 7,409,997 | B2 * | 8/2008 | Gay et al. | 166/369 |
| 7,857,604 | B2 | 12/2010 | Shaw et al. | |
| 2002/0153141 | A1 | 10/2002 | Hartman et al. | |
| 2004/0183491 | A1 | 9/2004 | Sidey | |
| 2004/0188096 | A1 | 9/2004 | Traylor | |
| 2006/0151211 | A1 | 7/2006 | Coenen et al. | |
| 2007/0175633 | A1 | 8/2007 | Kosmala et al. | |
| 2007/0252717 | A1 | 11/2007 | Fielder | |
| 2008/0236821 | A1 | 10/2008 | Fielder | |
| 2009/0010783 | A1 | 1/2009 | Appel et al. | |
| 2009/0056939 | A1 | 3/2009 | Hackworth et al. | |
| 2009/0175737 | A1 | 7/2009 | Intelisano | |
| 2010/0206554 | A1 * | 8/2010 | Neuhaus et al. | 166/244.1 |
| 2010/0288493 | A1 | 11/2010 | Fielder et al. | |

FOREIGN PATENT DOCUMENTS

| | | | |
|---|---|---|---|
| WO | 2004/113670 | A2 | 12/2004 |
| WO | 2006/136202 | A1 | 12/2006 |
| WO | 2008148613 | A2 | 12/2008 |

OTHER PUBLICATIONS

Chinese Office Action dated Sep. 29, 2013, Chinese Application 201080021677.3.

* cited by examiner

ELECTRIC SUBMERSIBLE PUMPING SYSTEM FOR DEWATERING GAS WELLS

BACKGROUND OF THE INVENTION

1. Field of the Invention

Embodiments of the present invention generally relate to an electric submersible pumping system for dewatering gas wells.

2. Description of the Related Art

As natural gas wells mature, many experience a decrease in production due to water build up in the annulus creating back pressure on the reservoir. The gas industry have utilized varying technologies to alleviate this problem, however most do not meet the economic hurdle as they require intervention such as pulling the tubing string.

SUMMARY OF THE INVENTION

Embodiments of the present invention generally relate to an electric submersible pumping system for dewatering gas wells. In one embodiment, a method of unloading liquid from a reservoir includes deploying a pumping system into a wellbore to a location proximate the reservoir using a cable. The pumping system includes a motor, an isolation device, and a pump. The method further includes setting the isolation device, thereby rotationally fixing the pumping system to a tubular string disposed in the wellbore and isolating an inlet of the pump from an outlet of the pump; supplying a power signal from the surface to the motor via the cable, thereby operating the pump and lowering a liquid level in the tubular string to a level proximate the reservoir; unsetting the isolation device; and removing the pump assembly from the wellbore using the cable.

In another embodiment, a pumping system includes a submersible high speed electric motor operable to rotate a drive shaft; a high speed pump rotationally fixed to the drive shaft; an isolation device operable to expand into engagement with a tubular string, thereby fluidly isolating an inlet of the pump from an outlet of the pump and rotationally fixing the motor and the pump to the tubular string; and a cable having two or less conductors, a strength sufficient to support the motor, the pump, and the isolation device, and in electrical communication with the motor. A maximum outer diameter of the motor, pump, isolation device, and cable is less than or equal to two inches.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
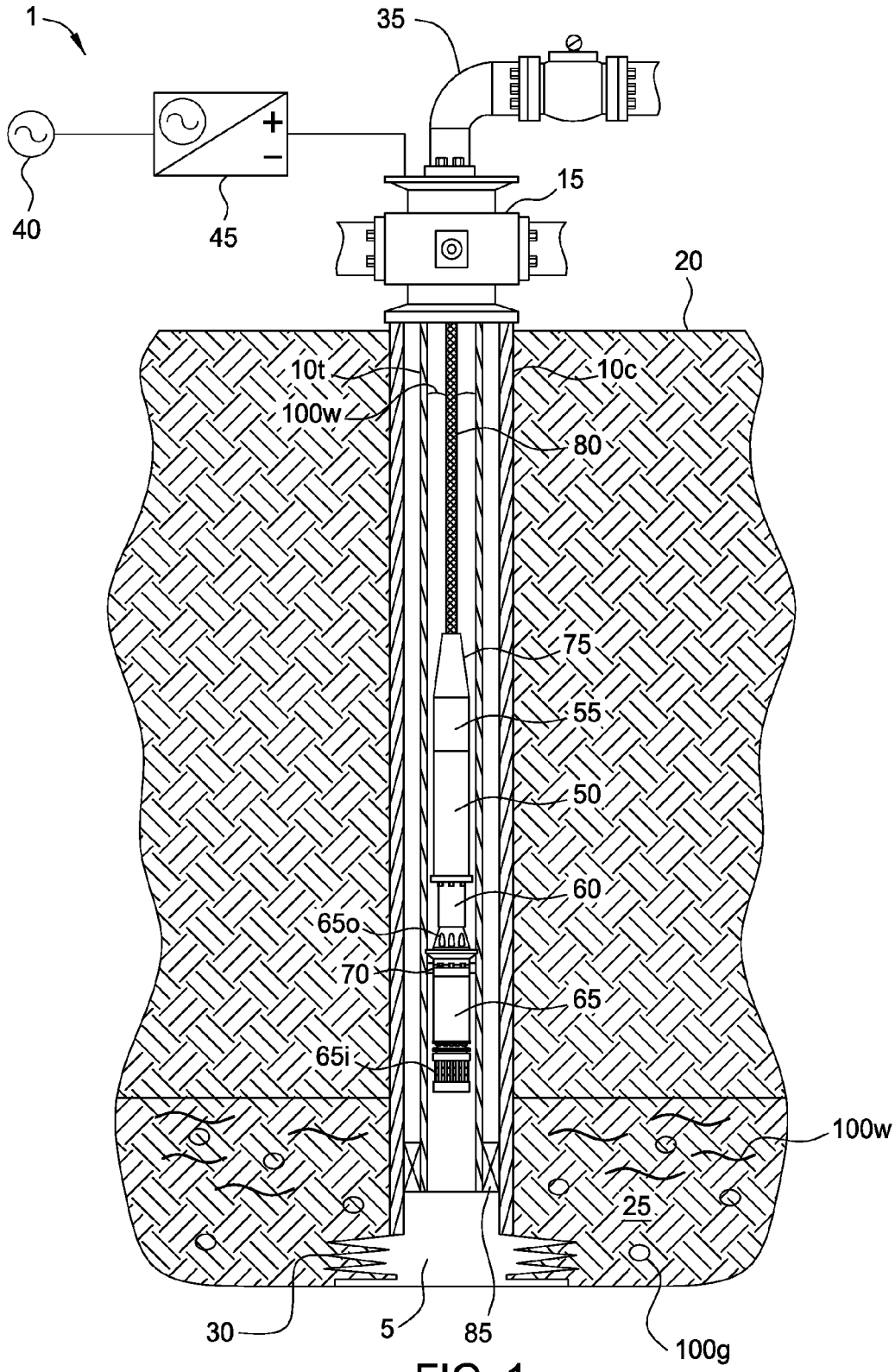
FIG. 1 illustrates an electric submersible pumping system deployed in a wellbore, according to one embodiment of the present invention.

FIG. 1 illustrates a pumping system 1 deployed in a wellbore 5, according to one embodiment of the present invention. The wellbore 5 has been drilled from a surface of the earth 20 or floor of the sea (not shown) into a hydrocarbon-bearing (i.e., natural gas 100*g*) reservoir 25. A string of casing 10*c* has been run into the wellbore 5 and set therein with cement (not shown). The casing 10*c* has been perforated 30 to provide to provide fluid communication between the reservoir 25 and a bore of the casing 10. A wellhead 15 has been mounted on an end of the casing string 10*c*. An outlet line 35 extends from the wellhead 15 to production equipment (not shown), such as a separator. A production tubing string 10*t* has been run into the wellbore 5 and hung from the wellhead 15. A production packer 85 has been set to isolate an annulus between the tubing 10*t* and the casing 10*c* from the reservoir 25. The reservoir 25 may be self-producing until a pressure of the gas 100*g* is no longer sufficient to transport a liquid, such as water 100*w*, to the surface. A level of the water 100*w* begins to build in the production tubing 10*t*, thereby exerting hydrostatic pressure on the reservoir 25 and diminishing flow of gas 100*g* from the reservoir 25.

The pumping system 1 may include a surface controller 45, an electric motor 50, a power conversion module (PCM) 55, a seal section 60, a pump 65, an isolation device 70, a cablehead 75, and a power cable 80. Housings of each of the components 50-75 may be longitudinally and rotationally fixed, such as flanged or threaded connections. Since the downhole components 50-80 may be deployed within the tubing 10*t*, the components 50-80 may be compact, such as having a maximum outer diameter less than or equal to two or one and three-quarter inches (depending on the inner diameter of the tubing 10*t*).

The surface controller 45 may be in electrical communication with an alternating current (AC) power source 40, such as a generator on a workover rig (not shown). The surface controller 45 may include a transformer (not shown) for stepping the voltage of the AC power signal from the power source 40 to a medium voltage (V) signal, such as five to ten kV, and a rectifier for converting the medium voltage AC signal to a medium voltage direct current (DC) power signal for transmission downhole via the power cable 80. The surface controller 45 may further include a data modem (not shown) and a multiplexer (not shown) for modulating and multiplexing a data signal to/from the PCM 55 with the DC power signal. The surface controller 45 may further include an operator interface (not shown), such as a video-display, touch screen, and/or USB port.

The cable 80 may extend from the surface controller 45 through the wellhead 15 or connect to leads which extend through the wellhead 15 and to the surface controller 45. The cable 80 may be received by slips or a clamp (not shown) disposed in or proximate to the wellhead 15 for longitudinally fixing the cable 80 to the wellhead 15 during operation of the pumping system 1. The cable 80 may extend into the wellbore 5 to the cablehead 75. Since the power signal may be DC, the cable 80 may only include two conductors arranged coaxially.

Figure 2A:
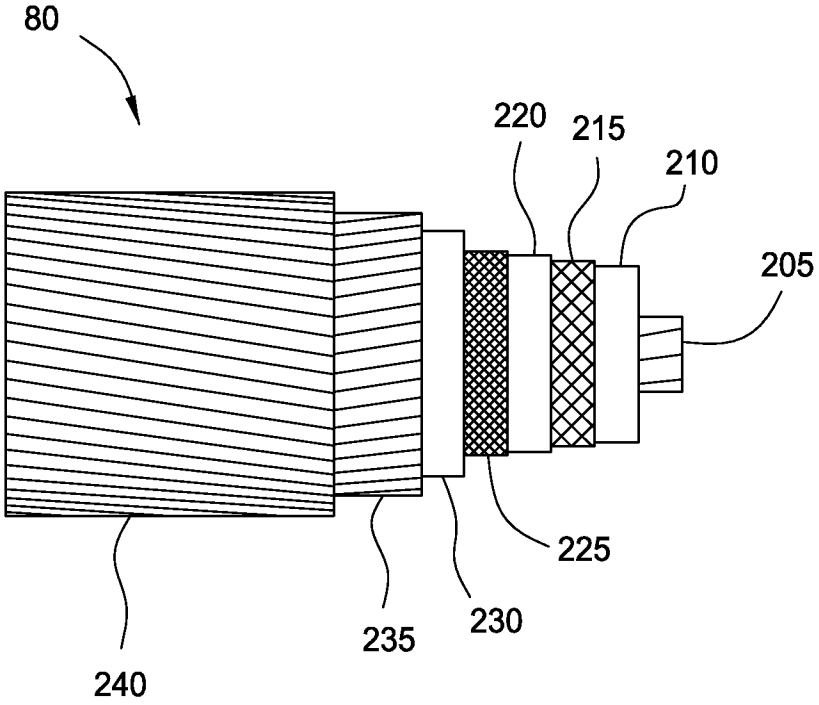
FIG. 2A is a layered view of the power cable.
Figure 2B:
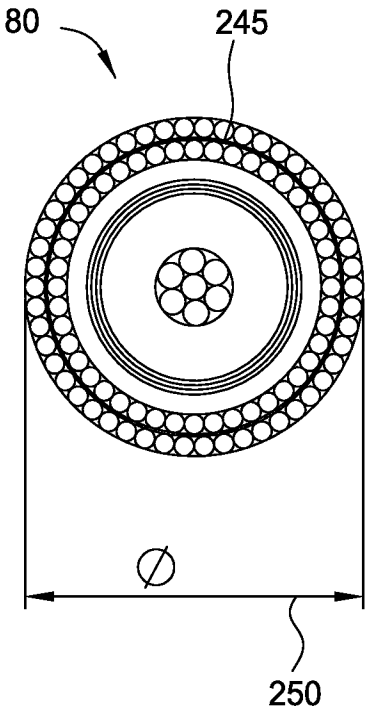
FIG. 2B is an end view of the power cable.

FIG. 2A is a layered view of the power cable 80. FIG. 2B is an end view of the power cable 80. The cable 80 may include an inner core 205, an inner jacket 210, a shield 215, an outer jacket 230, and armor 235, 240. The inner core 205 may be the first conductor and made from an electrically conductive material, such as aluminum, copper, aluminum alloy, or copper alloy. The inner core 205 may be solid or stranded. The inner jacket 210 may electrically isolate the core 205 from the shield 215 and be made from a dielectric material, such as a polymer (i.e., an elastomer or thermoplastic). The shield 215 may serve as the second conductor and be made from the electrically conductive material. The shield 215 may be tubular, braided, or a foil covered by a braid. The outer jacket 230 may electrically isolate the shield 215 from the armor 235, 240 and be made from an oil-resistant dielectric material. The armor may be made from one or more layers 235, 240 of high strength material (i.e., tensile strength greater than or equal to two hundred kpsi) to support the deployment weight (weight of the cable and the weight of the components 50-75) so that the cable 80 may be used to deploy and remove the components 50-75 into/from the wellbore 5. The high strength material may be a metal or alloy and corrosion resistant, such as galvanized steel or a nickel alloy depending on the corrosiveness of the gas 100*g*. The armor may include two contra-helically wound layers 235, 240 of wire or strip.

Additionally, the cable 80 may include a sheath 225 disposed between the shield 215 and the outer jacket 230. The sheath 225 may be made from lubricative material, such as polytetrafluoroethylene (PTFE) or lead and may be tape helically wound around the shield 215. If lead is used for the sheath, a layer of bedding 220 may insulate the shield 215 from the sheath and be made from the dielectric material. Additionally, a buffer 245 may be disposed between the armor layers 235, 240. The buffer 245 may be tape and may be made from the lubricative material.

Due to the coaxial arrangement, the cable 80 may have an outer diameter 250 less than or equal to one and one-quarter inches, one inch, or three-quarters of an inch.

Additionally, the cable 80 may further include a pressure containment layer (not shown) made from a material having sufficient strength to contain radial thermal expansion of the dielectric layers and wound to allow longitudinal expansion thereof. The material may be stainless steel and may be strip or wire. Alternatively, the cable 80 may include only one conductor and the tubing 10*t* may be used for the other conductor.

The cable 80 may be longitudinally fixed to the cablehead 75. The cablehead 75 may also include leads (not shown) extending therethrough. The leads may provide electrical communication between the conductors of the cable 80 and the PCM 55.

Figure 4:
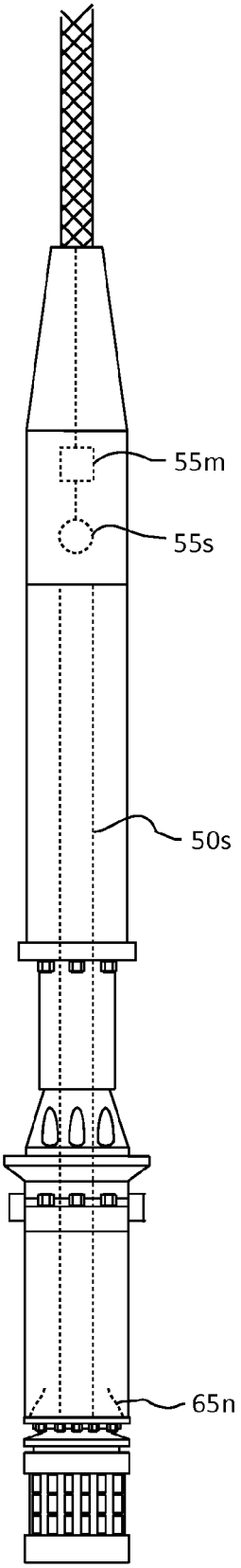
FIG. 4 illustrates downhole components of the electric submersible pumping system.

The motor 50 may be switched reluctance motor (SRM) or permanent magnet motor, such as a brushless DC motor (BLDC). The motor 50 may be filled with a dielectric, thermally conductive liquid lubricant, such as oil. The motor 50 may be cooled by thermal communication with the reservoir water 100*w*. The motor 50 may include a thrust bearing (not shown) for supporting a drive shaft 50*s* (FIG. 4). In operation, the motor 50 may rotate the shaft 50*s*, thereby driving the pump 65. The motor shaft 50*s* may be directly connected to the pump shaft (no gearbox). As discussed above, since the motor may be compact, the motor may operate at high speed so that the pump may generate the necessary head to pump the water 100*w* to the surface 20. High speed may be greater than or equal to ten thousand, twenty-five thousand, or fifty-thousand revolutions per minute (RPM). Alternatively, the motor 50 may be any other type of synchronous motor, an induction motor, or a DC motor.

The SRM motor may include a multi-lobed rotor made from a magnetic material and a multi-lobed stator. Each lobe of the stator may be wound and opposing lobes may be connected in series to define each phase. For example, the SRM motor may be three-phase (six stator lobes) and include a four-lobed rotor. The BLDC motor may be two pole and three phase. The BLDC motor may include the stator having the three phase winding, a permanent magnet rotor, and a rotor position sensor. The permanent magnet rotor may be made of a rare earth magnet or a ceramic magnet. The rotor position sensor may be a Hall-effect sensor, a rotary encoder, or sensorless (i.e., measurement of back EMF in undriven coils by the motor controller).

The PCM 55 may include a motor controller (not shown), a modem 55*m* (FIG. 4), and demultiplexer (not shown). The modem 55*m* and demultiplexer may demultiplex a data signal from the DC power signal, demodulate the signal, and transmit the data signal to the motor controller. The motor controller may receive the medium voltage DC signal from the cable and sequentially switch phases of the motor, thereby supplying an output signal to drive the phases of the motor. The output signal may be stepped, trapezoidal, or sinusoidal. The BLDC motor controller may be in communication with the rotor position sensor and include a bank of transistors or thyristors and a chopper drive for complex control (i.e., variable speed drive and/or soft start capability). The SRM motor controller may include a logic circuit for simple control (i.e. predetermined speed) or a microprocessor for complex control (i.e., variable speed drive and/or soft start capability). The SRM motor controller may use one or two-phase excitation, be unipolar or bi-polar, and control the speed of the motor by controlling the switching frequency. The SRM motor controller may include an asymmetric bridge or half-bridge.

Additionally, the PCM may include a power supply (not shown). The power supply may include one or more DC/DC converters, each converter including an inverter, a transformer, and a rectifier for converting the DC power signal into an AC power signal and stepping the voltage from medium to low, such as less than or equal to one kV. The power supply may include multiple DC/DC converters in series to gradually step the DC voltage from medium to low. The low voltage DC signal may then be supplied to the motor controller.

The motor controller may be in data communication with one or more sensors 55*s* (FIG. 4) distributed throughout the components 50-75. A pressure and temperature (PT) sensor may be in fluid communication with the water 100*w* entering the intake 65*i*. A gas to liquid ratio (GLR) sensor may be in fluid communication with the water 100*w* entering the intake 65*i*. A second PT sensor may be in fluid communication with the reservoir fluid discharged from the outlet 65*o*. A temperature sensor (or PT sensor) may be in fluid communication with the lubricant to ensure that the motor and downhole controller are being sufficiently cooled. Multiple temperature sensors may be included in the PCM for monitoring and recording temperatures of the various electronic components. A voltage meter and current (VAMP) sensor may be in electrical communication with the cable 80 to monitor power loss from the cable. A second VAMP sensor may be in electrical communication with the motor controller output to monitor performance of the motor controller. Further, one or more vibration sensors may monitor operation of the motor 50, the pump 65, and/or the seal section 60. A flow meter may be in fluid communication with the discharge 65*o* for monitoring a flow rate of the pump 65. Utilizing data from the sensors, the motor controller may monitor for adverse conditions, such as pump-off, gas lock, or abnormal power performance and take remedial action before damage to the pump 65 and/or motor 50 occurs.

The seal section 60 may isolate the water 100*w* being pumped through the pump 65 from the lubricant in the motor 50 by equalizing the lubricant pressure with the pressure of the reservoir fluid 100. The seal section 60 may rotationally fix the motor shaft to a drive shaft of the pump. The shaft seal may house a thrust bearing capable of supporting thrust load from the pump. The seal section 60 may be positive type or labyrinth type. The positive type may include an elastic, fluid-barrier bag to allow for thermal expansion of the motor lubricant during operation. The labyrinth type may include tube paths extending between a lubricant chamber and a reservoir fluid chamber providing limited fluid communication between the chambers.

The pump may include an inlet 65*i*. The inlet 65*i* may be standard type, static gas separator type, or rotary gas separator type depending on the GLR of the water 100*w*. The standard type intake may include a plurality of ports allowing water 100*w* to enter a lower or first stage of the pump 65. The standard intake may include a screen to filter particulates from the reservoir fluid. The static gas separator type may include a reverse-flow path to separate a gas portion of the reservoir fluid from a liquid portion of the reservoir fluid.

The pump 65 may be dynamic and/or positive displacement. The dynamic pump may be centrifugal, such a radial flow, mixed axial/radial flow, or axial flow, or a boundary layer (a.k.a. Tesla pump). The centrifugal pump may include a propeller (axial) or an open impeller (radial or axial/radial). The pump housing of the centrifugal pump may include a nozzle 65*n* to create a jet effect. The positive displacement may be screw or twin screw. The pump 65 may include one or more stages (not shown). Each stage may be the same type or a different type. For example, a first stage may be a positive displacement screw stage and the second stage may be centrifugal axial flow (i.e., propeller). An outer surface of the propeller, impeller, and/or screw may be hardened to resist erosion (i.e., carbide coated). The pump may deliver the pressurized reservoir fluid to an outlet 65*o* of the isolation device 70.

The pumping system 1 may further include an actuator (not shown) for setting and/or unsetting the isolation device 70. The actuator may include an inflation tool, a check valve, and a deflation tool. The check valve may be a separate member or integral with the inflation tool. The inflation tool may be an electric pump and may be in electrical communication with the motor controller or include a separate power supply in direct communication with the power cable. Upon activation, the inflation tool may intake reservoir fluid, pressurize the reservoir fluid, and inject the pressurized reservoir fluid through the check valve and into the isolation device. Alternatively, the inflation tool may include a tank filled with clean inflation fluid, such as oil for inflating the isolation device 70.

The isolation device 70 may include a bladder (not shown), a mandrel (not shown), anchor straps (not shown), and a sealing cover (not shown). The mandrel may include a first fluid path therethrough for passing the water 100*w* from the pump 65 to the outlet 65*o*, the outlet 65*o*, and a second fluid path for conducting reservoir fluid from the inflation tool to the bladder. The bladder may be made from an elastomer and be disposed along and around an outer surface of the mandrel. The anchor straps may be disposed along and around an outer surface of the bladder. The anchor straps may be made from a metal or alloy and may engage an inner surface of the casing 10 upon expansion of the bladder, thereby rotationally fixing the mandrel (and the components 50-75) to the tubing 10*t*. The anchor straps may also longitudinally fix the mandrel to the casing, thereby relieving the cable 80 from having to support the weight of the components 50-75 during operation of the pump 65. The cable 80 may then be relegated to a back up support should the isolation device 70 fail.

The sealing cover may be disposed along a portion and around the anchor straps and engage the casing upon expansion of the bladder, thereby fluidly isolating the outlet 65*o* from the intake 65*i*. The deflation tool may include a mechanically or electrically operated valve. The deflation tool may in fluid communication with the bladder fluid path such that opening the valve allows pressurized fluid from the bladder to flow into the wellbore, thereby deflating the bladder. The mechanical deflation tool may include a spring biasing a valve member toward a closed position. The valve member may be opened by tension in the cable 80 exceeding a biasing force of the spring. The electrical inflation tool may include an electric motor operating a valve member. The electric motor may be in electrical communication with the motor controller or in direct communication with the cable. Operation of the motor using a first polarity of the voltage may open the valve and operation of the motor using a second opposite polarity may close the valve.

Alternatively, instead of anchor straps on the bladder, the isolation device may include one or more sets of slips, one or more respective cones, and a piston disposed on the mandrel. The piston may be in fluid communication with the inflation tool for engaging the slips. The slips may engage the casing 10, thereby rotationally fixing the components 50-75 to the casing. The slips may also longitudinally support the components 50-75. The slips may be disengaged using the deflation tool.

Alternatively, instead of an actuator, hydraulic tubing (not shown) may be run in with the components 50-75 and extend to the isolation device 70. Hydraulic fluid may be pumped into the bladder through the hydraulic tubing to set the isolation device 70 and relieved from the bladder via the tubing to unset the isolation device 70. Alternatively, the isolation device 70 may include one or more slips (not shown), one or more respective cones (not shown), and a solid packing element (not shown). The actuator may include a power charge, a piston, and a shearable ratchet mechanism. The power charge may be in electrical communication with the motor controller or directly with the cable 80. Detonation of the power charge may operate the piston along the ratchet mechanism to set the slips and the packing element. Tension in the cable 80 may be used to shear the ratchet and unset the isolation device 70. Alternatively, hydraulic tubing may be used instead of the power charge. Alternatively, a second hydraulic tubing may be used instead of the ratchet mechanism to unset the packing element. Alternatively, the isolation device 70 may include an expandable element made from a shape memory alloy or polymer and include an electric heating element so that the expandable element may be expanded by operating the heating element and contracted by deactivating the heating element (or vice versa).

Additionally, the isolation device 70 may include a bypass vent (not shown) for releasing gas separated by the inlet 65*i* that may collect below the isolation device and preventing gas lock of the pump 65. A pressure relief valve (not shown) may be disposed in the bypass vent.

In operation, to install the pumping system 1, a workover rig (not shown) and the pumping system 1 may be deployed to the wellsite. Since the cable 80 may include only two conductors, the cable 80 may be delivered wound onto a drum (not shown). The wellhead 15 may be opened. The components 50-75 may be suspended over the wellbore 5 from the workover rig and an end of the cable 80 may be connected to the cablehead 75. The cable 80 may be unwound from the drum, thereby lowering the components 50-75 into the wellbore inside of the production tubing 10*t*. Once the components 50-75 have reached the desired depth proximate to the reservoir 25, the wellhead may be closed and the conductors of the cable 80 may be connected to the surface controller 45.

Additionally, a downhole tractor (not shown) may be integrated into the cable to facilitate the delivery of the pumping system, especially for highly deviated wells, such as those having an inclination of more than 45 degrees or dogleg severity in excess of 5 degrees per 100 ft. The drive and wheels of the tractor may be collapsed against the cable and deployed when required by a signal from the surface.

The isolation device 70 may then be set. If the isolation device 70 is electrically operated, the surface controller 45 may be activated, thereby delivering the DC power signal to the PCM 55 and activating the downhole controller 55. Instructions may be given to the surface controller 45 via the operator interface, instructing setting of the isolation device 70. The instructions may be relayed to the PCM 55 via the cable. The PCM 55 may then operate the actuator. Alternatively, as discussed above, the actuator may be directly connected to the cable. In this alternative, the actuator may be operated by sending a voltage different than the operating voltage of the motor. For example, since the motor may be operated by the medium voltage, the inflation tool may be operated at a low voltage and the deflation tool (if electrical) may be operated by reversing the polarity of the low voltage.

Once the isolation device 70 is set, the motor 50 may then be started. If the motor controller is variable, the motor controller may soft start the motor 50. As the pump 65 is operating, the motor controller may send data from the sensors to the surface so that the operator may monitor performance of the pump. If the motor controller is variable, a speed of the motor 50 may be adjusted to optimize performance of the pump 65. Alternatively, the surface operator may instruct the motor controller to vary operation of the motor. The pump 65 may pump the water 100*w* through the production tubing 10*t* and the wellhead 15 into the outlet 35, thereby lowering a level of the water 100*w* and reducing hydrostatic pressure of the water 100*w* on the formation 25. The pump 65 may be operated until the water level is lowered to the inlet 65*i* of the pump, thereby allowing natural production from the reservoir 25. The operator may then send instructions to the motor controller to shut down the pump 65 or simply cut power to the cable 80. The operator may send instructions to the PCM 55 to unset the isolation device 70 (if electrically operated) or the drum may be wound to exert sufficient tension in the cable 80 to unseat the isolation device 70. The cable 80 may be wound, thereby raising the components 50-75 from the wellbore 5. The workover rig and the pumping system 1 may then be redeployed to another wellsite.

Advantageously, deployment of the components 50-75 using the cable 80 inside of the production tubing 10*t* instead of removing the production tubing string and redeploying the production tubing string with a permanently mounted artificial lift system reduces the required size of the workover rig and the capital commitment to the well. Deployment and removal of the pumping system 1 to/from the wellsite may be accomplished in a matter of hours, thereby allowing multiple wells to be dewatered in a single day. Transmitting a DC power signal through the cable 80 reduces the required diameter of the cable, thereby allowing a longer length of the cable 80 (i.e., five thousand to eight thousand feet) to be spooled onto a drum, and easing deployment of the cable 80.

Figure 3:
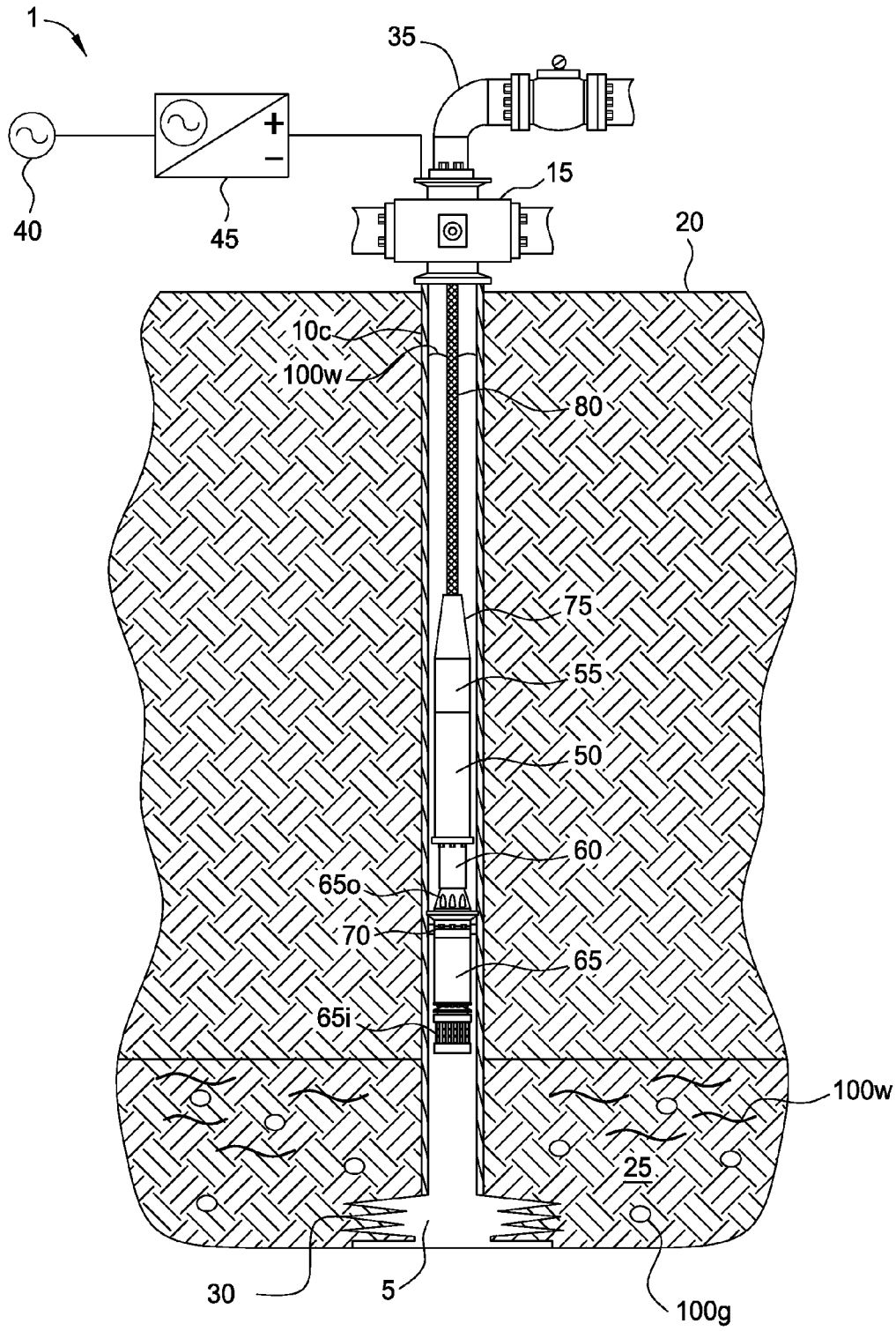
FIG. 3 illustrates an electric submersible pumping system deployed in a wellbore, according to another embodiment of the present invention.

FIG. 3 illustrates an electric submersible pumping system 1 deployed in a wellbore 5, according to another embodiment of the present invention. In this embodiment, the casing 10*c* has been used to produce fluid from the reservoir 25 instead of installing production tubing. In this scenario, the isolation device 70 may be set against the casing 10*c* and the pump 65 may discharge the water 100*w* to the surface 20 via a bore of the casing 10*c*.

While the foregoing is directed to embodiments of the present invention, other and further embodiments of the invention may be devised without departing from the basic scope thereof, and the scope thereof is determined by the claims that follow.

The invention claimed is:

1. A pumping system, comprising:

a surface controller operable to supply a direct current (DC) power signal to a coaxial cable;

a downhole assembly, comprising:

a submersible high speed switched reluctance electric motor operable to rotate a drive shaft;

a high speed centrifugal multi-stage pump for dewatering a gas well, rotationally fixed to the drive shaft, and having a housing including a nozzle operable to create a jet effect;

an isolation device having an expandable seal and an anchor and operable to expand into engagement with a tubular string, thereby fluidly isolating an inlet of the multi-stage pump from an outlet of the multi-stage pump and rotationally fixing the motor and the pump to the tubular string;

an actuator for expanding the isolation device independently of the multi-stage pump;

a power conversion module (PCM) operable to receive the DC power signal from the cable and sequentially switch the DC signal, thereby supplying an output power signal to the motor; and the cable having two coaxial conductors and high strength metal or alloy armor to support a dry weight of the downhole assembly and the cable and in electrical communication with the motor, wherein:

a maximum outer diameter of the downhole assembly and cable is less than or equal to two inches, the high speed of the motor and pump is greater than or equal to ten thousand revolutions per minute (RPM), and the actuator is connected to the PCM or the cable for operation thereby.

2. The pumping system of claim 1, wherein the DC and output signals are substantially greater than one kilovolt.

3. The pumping system of claim 2, wherein the output power signal is three-phase.

4. The pumping system of claim 1, wherein the PCM is operable to vary a speed of the motor.

5. The pumping system of claim 1, wherein the high speed of the motor and pump is greater than or equal to twenty-five thousand RPM.

6. The pumping system of claim 5, wherein the high speed of the motor and pump is greater than or equal to fifty thousand RPM.

7. The pumping system of claim 1, wherein the actuator comprises an inflation tool for setting the isolation device.

8. The pumping system of claim 7, wherein the inflation tool is an electric pump.

9. The pumping system of claim 1, wherein the downhole assembly further comprises a sensor; and a modem operable to send a measurement from the sensor along the cable.

10. The pumping system of claim 1, wherein the isolation device is further operable to support the weight of the downhole assembly.

11. The pumping system of claim 1, wherein:

the DC power signal is substantially greater than one kilovolt, and the PCM includes a power supply operable to reduce the DC power signal voltage, and the output power signal is less than or equal to one kilovolt.

* * * * *